US009123303B2

(12) United States Patent
Abe et al.

(10) Patent No.: US 9,123,303 B2
(45) Date of Patent: Sep. 1, 2015

(54) DISPLAY DEVICE, DISPLAY METHOD, AND PROGRAM

(75) Inventors: Masatoshi Abe, Tokyo (JP); Yutaka Arai, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 359 days.

(21) Appl. No.: 13/641,450

(22) PCT Filed: Apr. 23, 2010

(86) PCT No.: PCT/JP2010/002961

§ 371 (c)(1),
(2), (4) Date: Oct. 15, 2012

(87) PCT Pub. No.: WO2011/132236

PCT Pub. Date: Oct. 27, 2011

(65) Prior Publication Data

US 2013/0033529 A1 Feb. 7, 2013

(51) Int. Cl.

| | |
|---|---|
| ***G09G 5/10*** | (2006.01) |
| ***G09G 3/36*** | (2006.01) |
| ***G09G 3/34*** | (2006.01) |

(52) U.S. Cl.

CPC ..... *G09G 3/3611* (2013.01); *G09G 3/3406* (2013.01); *G09G 2320/0276* (2013.01);
(Continued)

(58) Field of Classification Search

CPC ..... G09G 3/3406; G09G 3/3611; G09G 2320/0276; G09G 2360/16; G09G 2320/0666; G09G 2330/021; G09G 2320/0646

USPC ..... 345/38, 50–54, 60–65, 87–104, 345/690–694; 349/815.4; 348/49, 751, 348/761–766, 790–794; 313/383

See application file for complete search history.

(56) References Cited

U.S. PATENT DOCUMENTS

2005/0057486 A1* 3/2005 Aoki et al. ..... 345/102
2005/0219198 A1 10/2005 Pasqualini et al.

(Continued)

FOREIGN PATENT DOCUMENTS

CN 1941866 A 4/2007
CN 101051443 A 10/2007

(Continued)

OTHER PUBLICATIONS

Chinese Office Action dated Aug. 28, 2014 with an English translation thereof.

(Continued)

*Primary Examiner* — Kumar Patel
*Assistant Examiner* — Vinh Lam
(74) *Attorney, Agent, or Firm* — McGinn IP Law Group, PLLC

(57) ABSTRACT

A display device includes: a display screen displaying screen images; a required-brightness computation unit computing required brightnesses for each of the screen images; a brightness determination unit comparing the required brightnesses computed for each of the screen images, and determining the screen image corresponding to the required brightness having highest brightness to be a maximum-required-brightness image; and a brightness control unit performing light-source brightness control and performing image gradation control, the light-source brightness control controlling the brightness of the light source so as to make the brightness of the light source the set brightness for the maximum-required-brightness image, the image gradation control controlling a gradation of the image displayed on the liquid-crystal panel in accordance with the brightness of the light source, so as to make a brightness of each of the screen images other than the maximum-required-brightness image the set brightness specified for each of the screen images.

14 Claims, 5 Drawing Sheets

(52) U.S. Cl.
CPC ..... *G09G2320/0646* (2013.01); *G09G 2320/0666* (2013.01); *G09G 2330/021* (2013.01); *G09G 2360/16* (2013.01)

(56) References Cited

U.S. PATENT DOCUMENTS

| | | | | |
|---|---|---|---|---|
| 2006/0256091 | A1* | 11/2006 | Hino | 345/173 |
| 2007/0075978 | A1* | 4/2007 | Chung | 345/173 |
| 2008/0111784 | A1* | 5/2008 | Tanaka et al. | 345/102 |
| 2008/0174544 | A1* | 7/2008 | Ueda et al. | 345/102 |
| 2008/0278432 | A1 | 11/2008 | Ohshima | |
| 2009/0009456 | A1 | 1/2009 | Ohshima | |
| 2009/0267890 | A1* | 10/2009 | Park et al. | 345/102 |
| 2009/0267926 | A1* | 10/2009 | Seo et al. | 345/204 |
| 2010/0039368 | A1* | 2/2010 | Kim et al. | 345/102 |
| 2010/0039440 | A1 | 2/2010 | Tanaka et al. | |
| 2010/0045694 | A1* | 2/2010 | Tanaka et al. | 345/589 |
| 2010/0060672 | A1* | 3/2010 | Hoppenbrouwers et al. | 345/690 |
| 2010/0117948 | A1* | 5/2010 | Hiramatsu et al. | 345/102 |
| 2010/0194791 | A1* | 8/2010 | Ogi et al. | 345/691 |
| 2010/0225574 | A1* | 9/2010 | Fujiwara et al. | 345/102 |
| 2011/0090265 | A1* | 4/2011 | Muroi et al. | 345/589 |

FOREIGN PATENT DOCUMENTS

| | | | |
|---|---|---|---|
| JP | 2003-122330 | A | 4/2003 |
| JP | 2005-521905 | A | 7/2005 |
| JP | 2007-281612 | A | 10/2007 |
| JP | 2008-304907 | A | 12/2008 |
| JP | 2009-271144 | A | 11/2009 |

OTHER PUBLICATIONS

International Search Report in PCT/JP2010/002961 dated Jun. 1, 2010(English Translation Thereof).

* cited by examiner

DISPLAY DEVICE, DISPLAY METHOD, AND PROGRAM

TECHNICAL FIELD

The present invention relates to a display device that has a light source for a backlight, a display method, and a program.

BACKGROUND ART

For example, a display device is known in which a display element such as a liquid-crystal panel is used as a display screen, and a light is radiated by a backlight from behind this display element to control the brightness of an image displayed on the display screen.

The brightness of the display device is the brightness measured from the front of the display element, and typically the brightness of the display screen is adjusted by controlling the brightness of the backlight, being a light source. By lowering the brightness of the display screen using this method, it is possible to reduce the power consumption of the backlight, so that an effect of power saving can be expected.

For the display device, there are a backlight that can suppress uneven brightness effectively while achieving a reduction in power consumption, and a liquid-crystal display device using the backlight (for example, refer to Patent Document 1).

Furthermore, the display device can display a plurality of screen images on a display screen, and there is also a requirement to adjust the brightness of each of the screen images in accordance with the brightness set for each of the screen images.

PRIOR ART DOCUMENT

Patent Document

[Patent Document 1] Japanese Unexamined Patent Application, First Publication No. 2009-271144

SUMMARY OF THE INVENTION

Problem to be Solved by the Invention

However, it is difficult to perform partial control of the brightness of the backlight, and there is a problem in that by adjusting the brightness of the backlight, the brightnesses of a plurality of screen images cannot be adjusted individually.

Therefore, the present invention is to provide a display device, a display method, and a program, whereby when a plurality of screen images is displayed on a display screen, the brightness of each of the screen images can be adjusted individually.

The present invention has been conceived to solve the above-described problems in consideration of such circumstances, with an object of providing a display device, a display method, and a program, which can adjust the brightnesses of a plurality of screen images displayed on a display screen individually.

Means for Solving the Problem

In order to solve the above-described problems, a display device according to the present invention includes a liquid-crystal panel and a light source that radiates light from a back of the liquid-crystal panel, and displaying an image on the liquid-crystal panel based on an input image signal, and includes: a display screen of the display panel, the display screen displaying a plurality of screen images; a required-brightness computation unit that computes required brightnesses for each of the screen images based on set brightness information indicating a set brightness specified for each of the screen images, the required brightnesses being a brightness of the light source required for making the display screen the set brightness; a brightness determination unit that compares the required brightnesses computed for each of the image screen, and determines the screen image corresponding to the required brightness having highest brightness among them to be a maximum-required-brightness image; and a brightness control unit that performs light-source brightness control and performs image gradation control, based on the determination result, the light-source brightness control controlling the brightness of the light source so as to make the brightness of the light source the set brightness for the maximum-required-brightness image, the image gradation control controlling a gradation of the image displayed on the liquid-crystal panel in accordance with the brightness of the light source, so as to make a brightness of each of the screen images other than the maximum-required-brightness image the set brightness specified for each of the screen images.

Moreover, the abovementioned display device may compute the required brightness for each of the screen images, based on white point setting information for setting a color temperature when white is displayed on the display screen.

Furthermore, the abovementioned display device may correct the white point setting information for setting a color temperature when white is displayed on the display screen in accordance with the brightness of the light source, and display on the liquid-crystal panel an image whose brightness is adjusted based on the white point setting information after correction.

Moreover, in order to solve the above-described problems, a display method according to the present invention is for a display device including a liquid-crystal panel and a light source that radiates light from a back of the liquid-crystal panel, and displaying an image on the liquid-crystal panel based on an input image signal, and includes the steps of computing required brightnesses for each of screen images based on set brightness information indicating a set brightness specified for each of the screen images, the required brightness being a brightness of the light source required for making the display screen the set brightness, in a display screen of the display panel displaying the screen images; comparing the required brightnesses computed for each of the image screen, and determining the screen image corresponding to the required brightness having highest brightness among them to be a maximum-required-brightness image; and performing light-source brightness control and performs image gradation control based on the determination result, the light-source brightness control controlling the brightness of the light source so as to make the brightness of the light source the set brightness for the maximum-required-brightness image, the image gradation control controlling a gradation of the image displayed on the liquid-crystal panel in accordance with the brightness of the light source, so as to make a brightness of each of the screen images other than the maximum-required-brightness image the set brightness specified for each of the screen images.

Furthermore, in order to solve the above-described problems, a program according to the present invention makes a computer function as: a required brightness computation means that computes required brightnesses for each of screen images based on set brightness information indicating a set brightness specified for each of the screen images, in a display screen of a display panel displaying the screen images, the required brightnesses being a brightness of the light source required for making the display screen the set brightness; a brightness determination means that compares the required brightnesses computed for each of the image screen, and determines the screen image corresponding to the required brightness having highest brightness among them to be a maximum-required-brightness image; and a brightness control means that performs light-source brightness control and performs image gradation control, based on the determination result, the light-source brightness control controlling the brightness of the light source so as to make the brightness of the light source the set brightness for the maximum-required-brightness image, the image gradation control controlling a gradation of the image displayed on the liquid-crystal panel in accordance with the brightness of the light source, so as to make a brightness of each of the screen images other than the maximum-required-brightness image the set brightness specified for each of the screen images.

Effect of the Invention

According to the present invention, it is possible to adjust the brightnesses of a plurality of screen images displayed on a display screen individually.

EMBODIMENTS FOR CARRYING OUT THE INVENTION

Next is a detailed description of an exemplary embodiment of the invention, with reference to the drawings.

Figure 1:
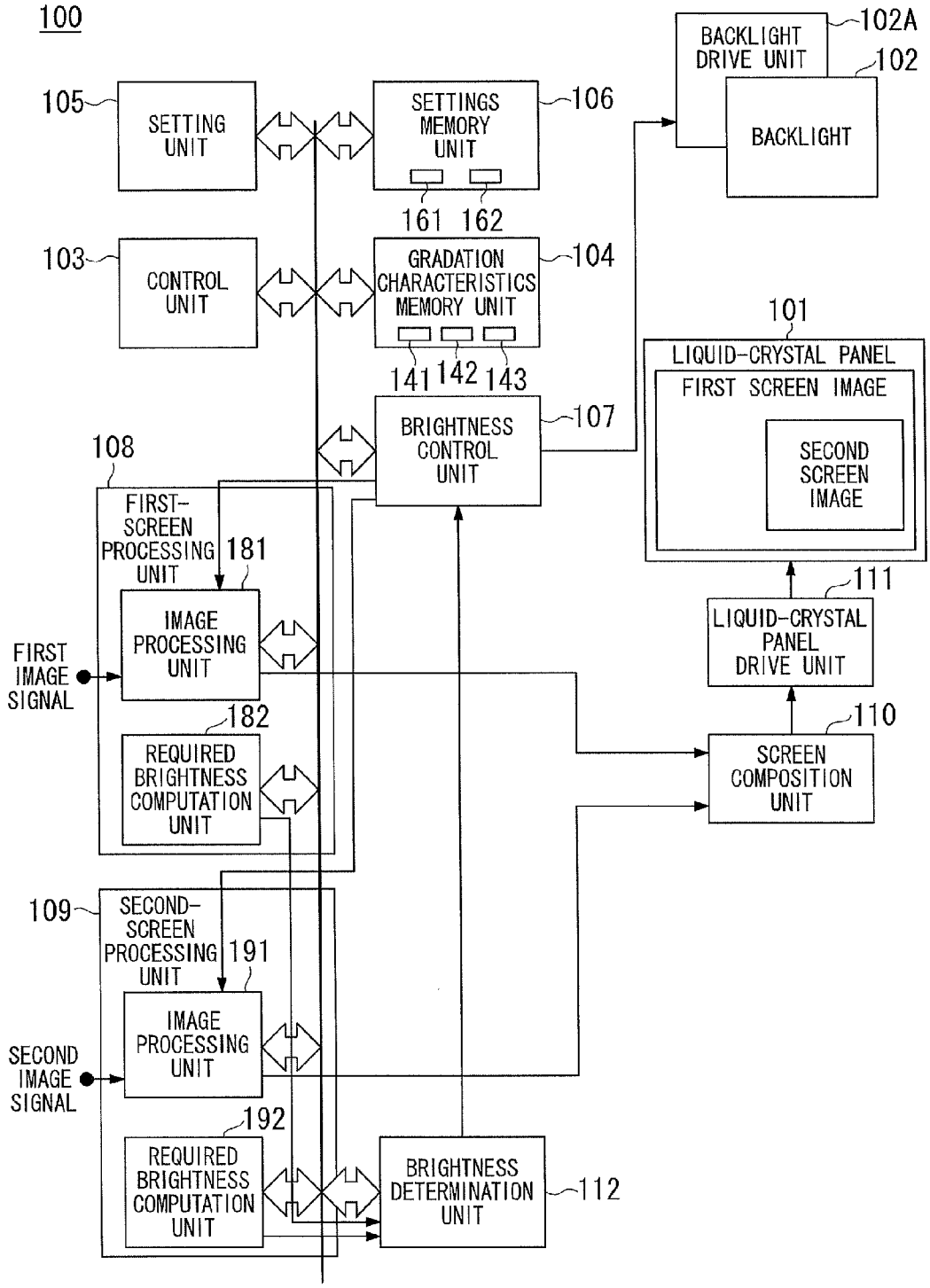
FIG. 1 is a schematic diagram for describing an example of a display device according to a present exemplary embodiment.

FIG. 1 is a diagram showing an example of a display device 100 according to the present exemplary embodiment.

As shown in FIG. 1, the display device 100 includes a liquid-crystal panel 101 being a display element, a backlight 102 being a light source, a control unit 103, a gradation characteristics memory unit 104, a setting unit 105, a settings memory unit 106, a brightness control unit 107, a first-screen processing unit 108, a second-screen processing unit 109, a screen composition unit 110, a liquid-crystal panel drive unit 111, and a brightness determination unit 112.

The liquid-crystal panel 101 has a single display screen, and displays a plurality of screen images (for example, a first screen image G1 and a second screen image G2) on this display screen. These screen images are for example windows or the like of a window system, and are display regions assigned in one display screen in accordance with application or image signals.

The first screen image G1 has for example a region with the same screen size as the display screen of the liquid-crystal panel 101. The second screen image G2 has for example a region with a smaller screen size than the first screen image G1.

The second screen image G2 is displayed overlapping the first screen image G1, and the first screen image G1 does not contain a part overlapping the second screen image G2. Furthermore, the first screen image G1 and the second screen image G2 may be images having a master and slave relationship like a parent image and a child image.

The backlight 102 is a CCFL (Cold Cathode Fluorescent Lamp) for example, and is driven by a backlight drive unit 102A under the control of the brightness control unit 107. The brightness of the backlight 102 is controlled by the brightness control unit 107.

The control unit 103 controls all of the configurations of the display device 100 collectively.

The gradation characteristics memory unit 104 stores the gradation characteristics of the liquid-crystal panel 101 being a display element. The gradation characteristics of the display element are characteristics relating to the brightness of each gradation when voltages are applied to the pixels of the display element. If the display element is a transmission type liquid-crystal panel, it indicates the ratio of the transmission factor of light of each of the gradations to the transmission factor of light when the gradation of an image signal is at its maximum. That is, it indicates the ratio of the output brightness when a specified gradation is input to the output brightness in the case where the maximum gradation is input. The gradation characteristics memory unit 104 stores the proportion as the gradation characteristics.

Furthermore, the ratio of the output brightness at the time of inputting a specified gradation, which the gradation characteristics memory unit 104 stores, may also be the proportion of the output brightnesses of red (R), green (G), and blue (B) to the output brightness of white (W) in the case where the maximum gradation is input, computed based on the brightness value of each of the gradations when a voltage is applied to a pixel of the liquid-crystal panel 101, being the display element.

The gradation characteristics memory unit 104 stores the gradation characteristic of the display element for each of white (W), red (R), green (G), and blue (B). The gradation characteristics corresponding to red (R) are stored in a liquid-crystal display panel R gradation characteristics region 141. The gradation characteristics corresponding to green (G) are stored in a liquid-crystal display panel G gradation characteristics region 142. The gradation characteristics corresponding to blue (B) are stored in a liquid-crystal display panel B gradation characteristics region 143.

Regarding the gradation characteristics of white, a computation method may be such that instead of storing them by themselves, by storing the RGB ratios, or by having advance information to compute the RGB ratio in accordance with the white chromaticity point, they are computed based on this information.

It is desirable that the relationship between the image gradation and the brightness is obtained in advance for each liquid-crystal panel in order to reproduce the colors more accurately.

The setting unit 105 inputs for example setting information such as set brightness information, white point chromaticity setting information, and gamma characteristics setting information (CRT gamma, DICOM gamma, user setting, and the like) of each screen image.

The settings memory unit 106 stores setting information input by the setting unit 105. For example, the settings memory unit 106 includes a first-screen setting region 161 that stores setting information set with respect to the first screen image G1, and a second-screen setting region 162 that stores setting information set with respect to the second screen image G2.

The first-screen setting region 161 stores the set brightness information T1 of the first screen image G1, and the white point setting information $R_w$:$G_w$:$B_w$, which are set with respect to the first screen image G1.

Moreover, the second-screen setting region 162 stores the set brightness information T2 of the second screen image G2, and the white point setting information $R_w$:$G_w$:$B_w$, which are set with respect to the second screen image G2.

Gamma characteristics are settings of a CRT gamma of 2.2 which is typical for a display device 100, or DICOM gamma, and the like, and the arrangement may be such that curves may be set freely in accordance with a user's preference.

The white point setting sets the color temperature when white is displayed on the display screen, and in the case of three primary colors R, G, and B, it is set by the ratio of R, and B to be mixed. The white point setting information indicating the setting of a white point is indicated by $R_w$:$G_w$:$B_w$, which is the proportion of the colors to be mixed.

A specific color temperature is obtained by converting the gradation of the image signal by the set proportion $R_w$:$G_w$:$B_w$, and by changing the proportion of the brightnesses of R, and B. Typically, it is set to around 6500K. It is desirable to be able to set the color temperature to such as 5400K, 10500K or the like in accordance with a user's preference.

The brightness control unit 107 changes the brightness of a screen image whose required brightness of the backlight 102 is the highest, by controlling the brightness of the backlight 102, based on the determination result determined by the brightness determination unit 112. The control to adjust the brightness of a screen image by controlling the brightness of the backlight 102 in this manner is hereunder referred to as backlight control.

Furthermore, the brightness control unit 107 changes the brightness of the other screen images (that is, the screen images other than the screen image whose required brightness of the backlight 102 is the highest) by controlling the gradation of the image signal based on the determination result determined by the brightness determination unit 112. The control to adjust the brightness of a screen image by controlling the gradation of the image signal in this manner is hereunder referred to as image gradation control.

For example, in the case where a plurality of screen images G1 and G2 is displayed on the liquid-crystal panel 101, and the required brightness Y1 of the first screen image G1 is the highest, the brightness control unit 107 performs backlight control to adjust the brightness of the backlight 102 in accordance with the brightness of the first screen image G1 based on this determination result.

The brightness of the whole display screen is changed by changing the brightness of the first screen image G1 by the brightness control unit 107 in this manner. Accordingly, the brightness control unit 107 performs image gradation control to reduce the brightness of the second screen image G2, being not the first screen image G1, by the difference.

That is, in the case where the brightness control unit 107 changes the brightness of the screen image whose required brightness of the backlight 102 is the highest it performs backlight control, and also performs image gradation control with respect to the other screen images to control the gradation of the image signal in accordance with the change of the brightness of the backlight 102.

On the other hand, in the case where the brightness control unit 107 changes the brightness of the screen images other than that whose required brightness of the backlight 102 is the highest, it performs only image gradation control to control the gradation of the image signal indicating the screen image concerned without changing the brightness of the backlight 102.

For example, the brightness (for example, setting information) of the first screen image is gradually reduced from a state in which the required brightness Y1 of the first screen image G1 is the highest (required brightness Y1 of the first screen image G1>required brightness Y(n+1) (n=1, 2, . . . ) of other screen images). Thereupon, the required brightness Y1 of the first screen image G1 and the required brightness Y2 of the second screen image G2 are both at their highest (the required brightness Y1 of the first screen image G1=the required brightness Y2 of the second screen image G2>the required brightness of another screen image Y(n+2)), and if the brightness (for example, setting information) of the first screen image G1 is further reduced, then Y2>Y1>Y(n+2).

In this case, the brightness control unit 107 changes the brightnesses of the first screen image G1 and the second screen image G2, whose required brightnesses of the backlight 102 are highest. That is, firstly (in a state where Y1>Y(n+1)), backlight control is performed to control the brightness of the backlight in accordance with the required brightness Y1 of the first screen image G1. However, in the case where the required brightness Y2 of the second screen image G2 reaches the maximum (in a state of Y2>Y1), the brightness control unit 107 switches the brightness control of the second screen image G2 from image gradation control to backlight control. That is, the brightness control unit 107 performs backlight control to control the brightness of the backlight in accordance with the required brightness Y2 of the second screen image G2. Furthermore, the brightness control unit 107 performs image gradation control with respect to the other screen images to control the gradation of the image signal in accordance with the change of the brightness of the backlight 102.

The first-screen processing unit 108 includes an image processing unit 181 and a required-brightness computation unit 182.

The second-screen processing unit 109 includes an image processing unit 191 and a required-brightness computation unit 192.

The image processing units 181 and 191 perform image processing based on conversion of the resolution of an input image signal, the setting information read from the settings memory unit 106 accompanying various settings and gradation characteristics read from the gradation characteristics memory unit 104.

The required-brightness computation units 182 and 192 compute the required brightnesses Y1 and Y2 of the backlight 102 required for each of the screen images G1 and G2 based on the transmittance characteristics of the liquid-crystal panel 101, the white point setting $R_w$:$G_w$:$B_w$, the set brightnesses T1 and T2, and the like, which are read from the gradation characteristics memory unit 104 and the settings memory unit 106.

The detail of the computation method will be described later.

The screen composition unit 110 composes a plurality of screen images G1 and G2 into a "specific state". The "specific state" means the display state of a plurality of screen images on the display screen of the liquid-crystal panel 101. For example, the image composition unit 110 composes the first screen image G1 and the second screen image G2 based on the "specific state" in which a first screen image G1 is displayed on the whole display screen of the display device 100, and a second screen image G2 is placed overlapping a part of the first screen image G1.

Furthermore, the "specific state" may be an arrangement state determined arbitrarily based on the setting information input by the setting unit 105, or in accordance with the number and the screen size of a plurality of display images displayed on the liquid-crystal panel 101. For example, the arrangement may be such that the first screen image G1 and the second screen image G2 are placed side by side freely on the whole or a part of the display screen of the display device 100. Moreover, in the case where the first screen image G1 and the second screen image G2 are displayed in a part of the display screen, the rest of the display screen may display black, for example.

The liquid-crystal panel drive unit 111 has a function to display images by driving the liquid-crystal display panel 101 based on a composite image signal input from the image composition unit 110.

The brightness determination unit 112 compares the required brightness Y1 of the first screen image G1 and the required brightness Y2 of the second screen image G2, which are input from the required-brightness computation units 182 and 192, and determines the screen image corresponding to the required brightness for which the brightness is the highest to be the maximum-required-brightness image. The brightness determination unit 112 outputs, as the determination results, the screen image with the maximum-required-brightness image and its required brightness, and the screen image other than the maximum-required-brightness image and its required brightness, to the brightness control unit 107.

Figure 2:
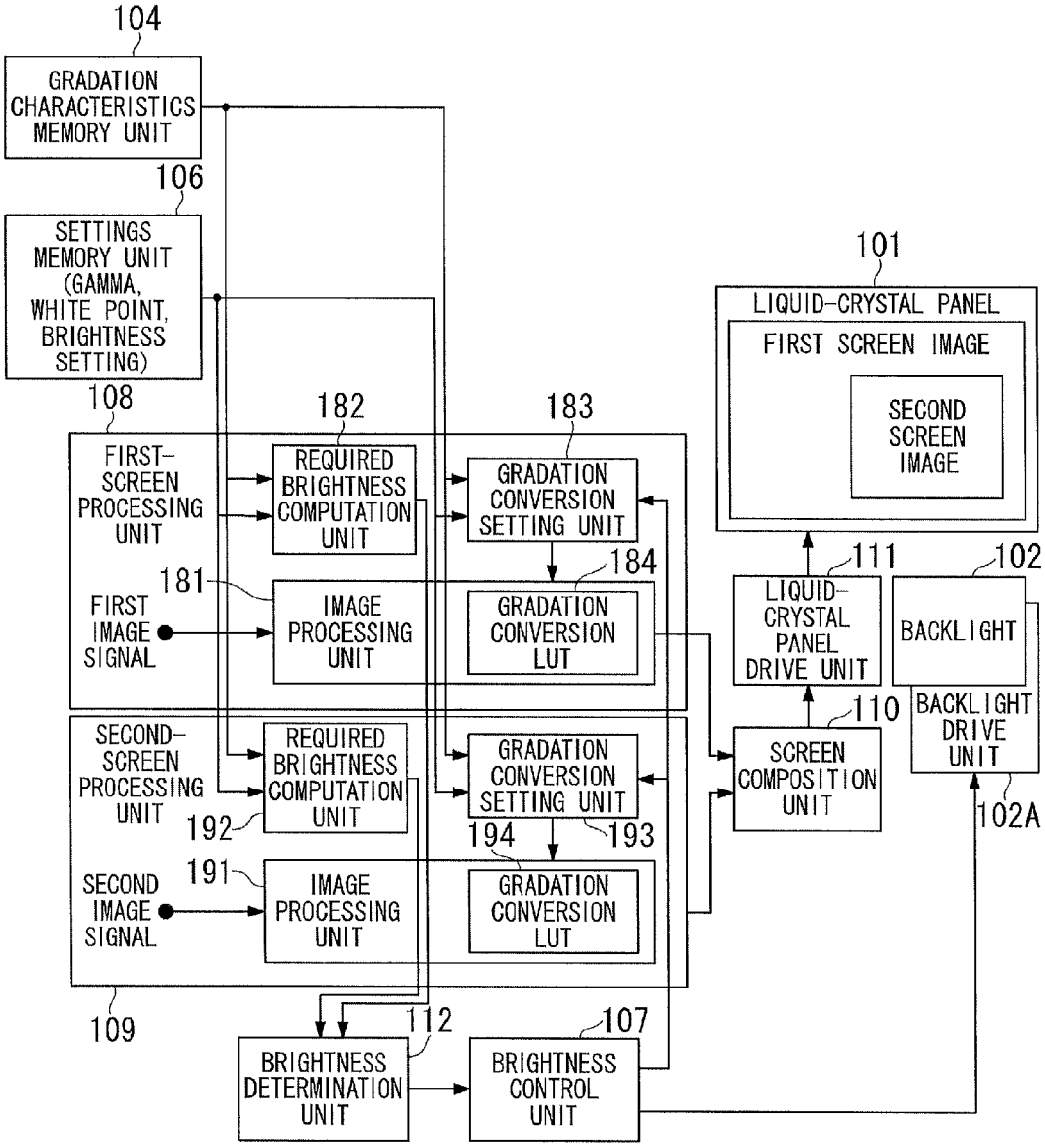
FIG. 2 is a diagram for describing processing in the display device shown in FIG. 1.
Figure 3:
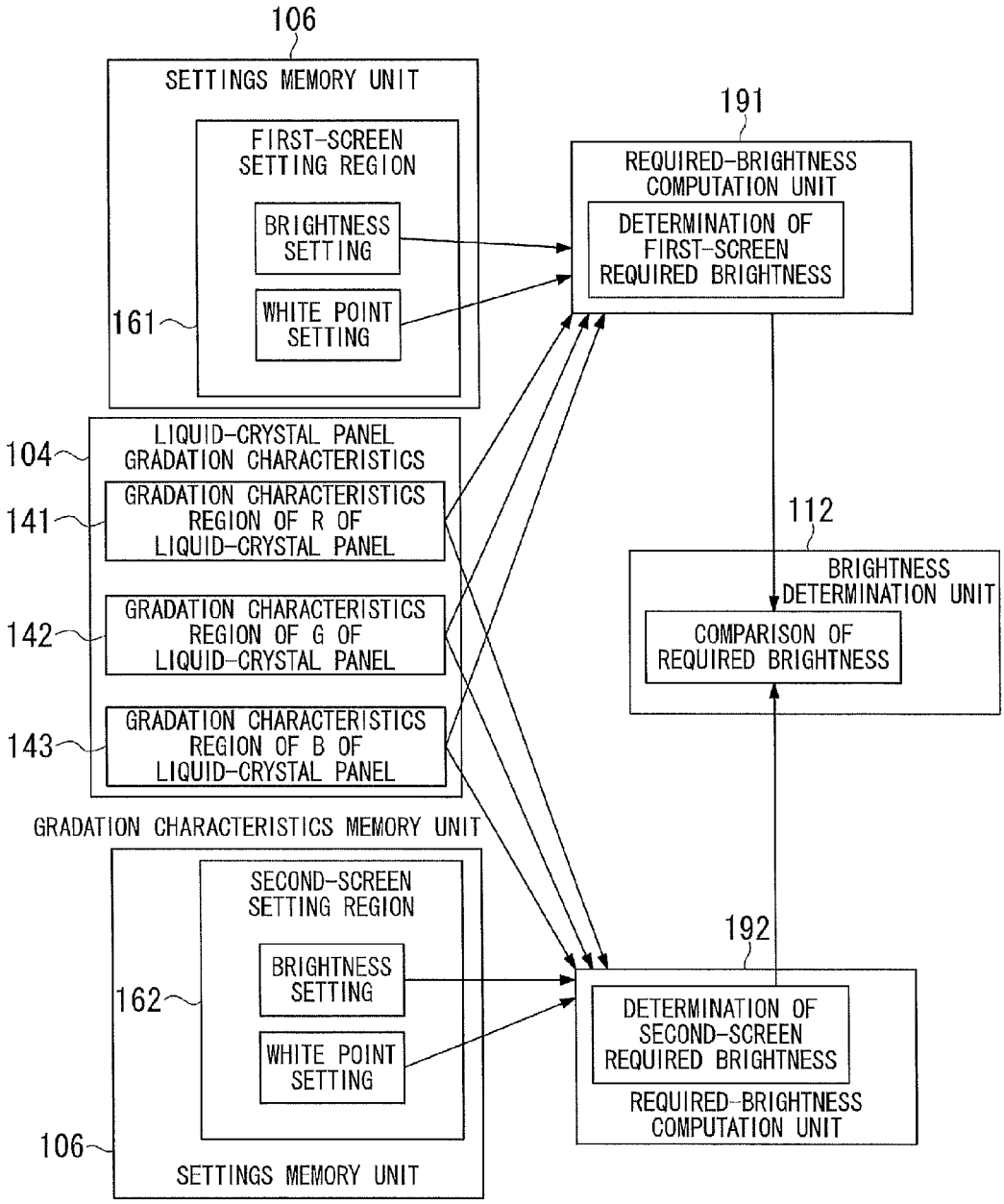
FIG. 3 is a diagram for describing processing in the display device shown in FIG. 1.

Next is a description of the computation method for the required brightnesses Y1 and Y2 of the backlight 102 by the required-brightness computation units 182 and 192, with reference to FIGS. 2 and 3.

FIGS. 2 and 3 are diagrams for describing processing of the display device shown in FIG. 1. Configuration the same as that described for FIG. 1, is denoted by the same reference symbols and detailed description is omitted.

The required-brightness computation unit 182 reads the transmittance characteristics information of the liquid-crystal panel 101, the white point setting information $R_w$:$G_w$:$B_w$, corresponding to the first screen image G1, the set brightness information T1 corresponding to the first screen image G1, and the proportion $R_{tw}$:$G_{tw}$:$B_{tw}$ of the brightnesses of each of the colors with respect to white, from the gradation characteristics memory unit 104 and the settings memory unit 106.

Moreover, the required-brightness computation unit 192 reads the transmittance characteristics information of the liquid-crystal panel 101, the white point setting information $R_w$:$G_w$:$B_w$ corresponding to the second screen image G2, the set brightness information T2 corresponding to the second screen image G2, and the proportion $R_{tw}$:$G_{tw}$:$B_{tw}$, of the brightnesses of each of the colors with respect to white, from the gradation characteristics memory unit 104 and the settings memory unit 106.

The transmittance characteristics information is for example the maximum value of the transmission factor $T_{max}$ (transmission factor at the time of maximum input gradation), being the ratio of the output light to the input light of the liquid-crystal panel 101, which is determined in advance for each of the colors, R, and B. Here, the transmittance characteristics information at the time of $R_w$:$G_w$:$B_w$=1.0:1.0:1.0 is transmission factor $T_{max}$=5%. The set brightness information T1, which corresponds to the first screen image G1, =160 cd/m$^2$, and the set brightness information T2, which corresponds to the second screen image G2, =150 cd/m$^2$. The proportion of the brightnesses of each of the colors with respect to white when white is displayed on the liquid-crystal panel 101 is $R_{tw}$:$G_{tw}$:$B_{tw}$, =20%:70%:10%.

For example, in the case where the white point setting information corresponding to the first screen image G1 is $R_w$:$G_w$:$B_w$=1.0:0.9:0.8, the required-brightness computation unit 182 computes the brightness ratio of the liquid-crystal panel being $R_t$:$G_t$:$B_t$=20%:63%:8%, with reference to the brightness proportion of each of the colors with respect to white being $R_{tw}$:$G_{tw}$:$B_{tw}$=20%:70%:10%, when white is displayed on the liquid-crystal panel 101. That is, the required-brightness computation unit 182 computes the brightness ratio of the liquid-crystal panel being $R_t$:$G_t$:$B_t$=20%:63%:8%, by multiplying the white point setting information being $R_w$:$G_w$:$B_w$=1.0:0.9:0.8 by the brightness proportion of each of the colors with respect to white being $R_{tw}$:$G_{tw}$:$B_{tw}$=20%:70%:10%.

Then, the required-brightness computation unit 182 computes the required brightness Y1 of the backlight 102 required for the first screen image G1 as follows based on the brightness ratio of the liquid-crystal panel being $R_t$:$G_t$:$B_t$=20%:63%:8%, the set brightness information being T1=160 cd/m$^2$, and the transmission factor being $T_{max}$=5%.

$$\text{Required brightness } Y1 = \text{Set brightness } L1 / \begin{pmatrix} \text{Brightness ratio } R_t + \\ \text{Brightness ratio } G_t + \\ \text{Brightness ratio } B_t \end{pmatrix} \times \text{Transmission factor } T_{max} = \frac{160[\text{cd/m}^2]}{((20+63+8)[\%] \times 5[\%])} = 3516[\text{cd/m}^2] \quad \text{equation (1)}$$

Furthermore, in the case where the white point setting information corresponding to the second screen image G2 is $R_w$:$G_w$:$B_w$=0.9:0.8:1.0, the required-brightness computation unit 192 computes the brightness ratio of the liquid-crystal panel being $R_t$:$G_t$:$B_t$=18%:56%:10%, with reference to the brightness proportion of each of the colors with respect to white being $R_{tw}$:$G_{tw}$:$B_{tw}$=20%:70%:10%, when white is displayed on the liquid-crystal panel 101. That is, the required-brightness computation unit 192 computes the brightness ratio of the liquid-crystal panel being $R_t$:$G_t$:$B_t$=18%:56%:10%, by multiplying the white point setting information being $R_w$:$G_w$:$B_w$=0.9:0.8:1.0 by the brightness proportion of each of the colors with respect to white being $R_{tw}$:$G_{tw}$:$B_{tw}$=20%:70%:10%.

Then, the required-brightness computation unit 192 computes the required brightness Y2 of the backlight 102 required for the second screen image G2 as follows based on the brightness ratio of the liquid-crystal panel 101 being $R_t$:$G_t$:$B_t$=18%:56%:10%, the set brightness information being T2=150 cd/m$^2$, and the transmission factor being $T_{max}$=5%.

$$\text{Required brightness } Y2 = \text{Set brightness } L2 / \begin{pmatrix} \text{Brightness ratio } R_t + \\ \text{Brightness ratio } G_t + \\ \text{Brightness ratio } B_t \end{pmatrix} \times \text{Transmission factor } T_{max} = \frac{150[\text{cd/m}^2]}{((18+56+10)[\%] \times 5[\%])} = 3571[\text{cd/m}^2]$$

The required-brightness computation units 182 and 192 output the computed required brightnesses Y1 and Y2 to the brightness determination unit 112.

Then, the brightness determination unit 112 compares the required brightnesses Y1 and Y2, and determines that the required brightness Y2 of the second screen image G2 is higher than the required brightness Y1 of the first screen image G1 (Y1<Y2). That is, the brightness determination unit 112 determines that the second screen image G2 is the maximum-required-brightness image.

The brightness determination unit 112 outputs the second screen image G2, being the maximum-required-brightness image, and its required brightness being Y2=3571 [cd/m$^2$], and the first screen image G1, being not the maximum-required-brightness image, and its required brightness being Y1=3516 [cd/m$^2$], to the brightness control unit 107 as the determination results.

Next is a description of a control method of the brightness in accordance with the determination of the required brightness of the backlight 102.

The brightness control unit 107 determines which of backlight control or image gradation control is necessary for the control of the brightness of each of the screen images, based on the determination result input from the brightness determination unit 112.

As described above, since the required brightness Y2 of the second screen image G2 is higher (Y1<Y2), then in the case where there is an instruction to change the brightness of the second screen image G2, being the maximum-required-brightness image, the brightness control unit 107 changes the brightness of the second screen image G2 to the set brightness information T2 based on backlight control.

For example, the brightness control unit 107 controls the backlight drive unit 102A so that the brightness of the backlight 102 becomes the required brightness Y2. As a result, the backlight drive unit 102A drives the backlight 102.

That is, in the case where an image signal for which image processing has been performed based on the white point setting information $R_w$:$G_w$:$B_w$=0.9:0.8:1.0, which is set for the second screen image G2, is displayed on the liquid-crystal panel 101, the brightness control unit 107 drives the backlight 102 with the brightness of the backlight 102 that is required for the brightness of the second screen image G2 to be the set brightness information T2.

On the other hand, the brightness control unit 107 changes the brightness of the first screen image G1, being not the maximum-required-brightness image, based on image gradation control.

For example, the brightness control unit 107 corrects the white point setting information in accordance with the change of the brightness of the backlight 102 by means of the backlight control, and outputs the white point setting information after correction, to the gradation conversion setting unit 183.

The brightness control unit 107 corrects the white point setting information in accordance with the brightness of the backlight 102 as follows, and adjusts the brightness of the first screen image G1, for example.

$$R_w = 1.0 \times 3516/3571 = 0.9846$$

$$G_w = 0.9 \times 3516/3571 = 0.8861$$

$$B_w = 0.8 \times 3516/3571 = 0.7876$$

The gradation conversion setting unit 183 reads in advance the white point setting information $R_w$:$G_w$:$B_w$ corresponding to the first screen image G1 from the settings memory unit 106, and stores it in its own storage unit.

Similarly, the gradation conversion setting unit 193 reads in advance the white point setting information $R_w$:$G_w$:$B_w$ corresponding to the second screen image G2 from the settings memory unit 106, and stores it in its own storage unit.

Here the white point setting information after correction is input to the gradation conversion setting unit 183 from the brightness control unit 107. The gradation conversion setting unit 183 updates the white point setting information stored in its own storage unit to the corrected white point setting information, and outputs the corrected white point setting information to the image processing unit 181. That is, the white point setting information after correction is set to the gradation conversion setting unit 183.

Based on the corrected white point setting information, the image processing unit 181 converts the input first image signal with reference to a gradation conversion LUT (Look Up Table) 184. The same method as conventional image gradation control of a liquid-crystal panel can be used for this, hence its detailed description is omitted.

The image processing unit 181 outputs the image signal for which image gradation control has been performed with respect to the first image signal, based on corrected white point setting information, to the image composition unit 110.

On the other hand, the image processing unit 191 receives the input from the gradation conversion setting unit 193 of the white point setting information $R_w$:$G_w$:$B_w$ corresponding to the second screen image G2, which the gradation conversion setting unit 193 reads from the settings memory unit 106 and stores in its own storage unit. That is, the image processing unit 191 performs image processing with respect to the second image signal based on the white point setting information that has not been corrected by the brightness control unit 107. Then, the image processing unit 191 outputs the image signal for which image processing has been performed to the image composition unit 110.

The screen composition unit 110 composes the first screen image G1 and the second screen image G2 to a "specific state" based on the image signal input from the image processing unit 181 and the image signal input from the image processing unit 191, generates a composite image signal, and outputs it to the liquid-crystal panel drive unit 111.

The liquid-crystal panel drive unit 111 displays an image by driving the liquid-crystal panel 101 based on the input composite image signal.

In this manner, the display device according to the present exemplary embodiment can adjust the brightness of a plurality of screen images individually without partial control of the brightness of the backlight 102.

Furthermore, the required-brightness computation units 182 and 192 according to the present exemplary embodiment compute the required brightnesses on the basis of the white point setting information set for each of the screen images. As a result, it is possible to set the brightnesses of a plurality of screen images even if the white point is changed.

Moreover, the brightness control unit 107 corrects the white point setting information on the display screen in accordance with the brightness of the backlight 102, and displays the image whose brightness has been adjusted based on the white point setting information after correction, on the liquid-crystal panel 101. As a result, it is possible to set the brightnesses of a plurality of screens while maintaining the gradation.

Figure 4:
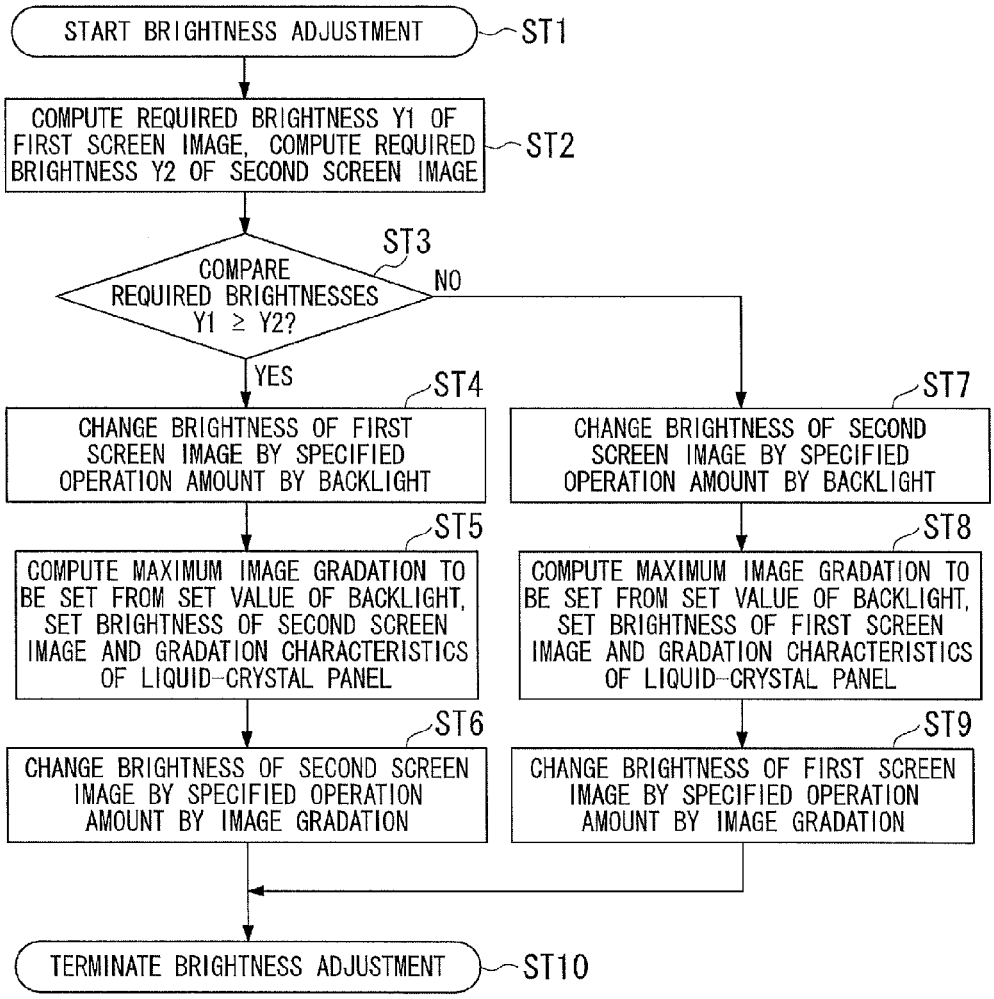
FIG. 4 is a flow chart for describing an example of a display method of the display device according to the present exemplary embodiment.

Next is a description of one example of a display method of the display device 100 according to the present exemplary embodiment with reference to FIG. 4. FIG. 4 is a flow chart for describing the example of the display method of the display device 100 according to the present exemplary embodiment. Here, a case is described in which two screen images of the first screen image G1 and the second screen image G2 are displayed on the display screen of the liquid-crystal panel 101. However, the present invention is not limited to this, but can also be realized in the case of more screen images by performing similar control appropriately.

As shown in FIG. 4, in the case where set brightnesses are set for each of the screen images, or in the case where the fact that a predetermined time has elapsed is measured by a timer unit, or in the case where the required brightness changes due to other conditions, the display device 100 starts brightness adjustment (step ST1).

As a result, the required-brightness computation units 182 and 192 compute the required brightnesses Y1 and Y2 of the backlight 102 required for the screen images G1 and G2 based on the transmittance characteristics of the liquid-crystal panel 101, the white point setting $R_w$:$G_w$:$B_w$, and the set brightness information T1 and T2 (step ST2).

Next, the required brightnesses Y1 and Y2 are input to the brightness determination unit 112, and the brightness determination unit 112 compares the required brightnesses Y1 and Y2 (step ST3).

Here, in the case where the required brightness Y1 is greater than the required brightness Y2 (Y1≥Y2), the brightness determination unit 112 outputs the first screen image G1, being the maximum-required-brightness image, and its required brightness Y1, and the second screen image G2, being not the maximum-required-brightness image, and its required brightness Y2, to the brightness control unit 107 as the determination result.

Then, the brightness control unit 107 changes the brightness of the first screen image G1, whose required brightness of the backlight 102 is the highest, by backlight control based on the determination result determined by the brightness determination unit 112. That is, the brightness control unit 107 changes the brightness of the first screen image G1 by the specified operation amount by backlight, and controls the brightness of the backlight 102 to the required brightness Y1 of the first screen image G1 (step ST4).

Next, the brightness control unit 107 also performs image gradation control with respect to the other, second screen image G2, to control the gradation of the image signal in accordance with the change of the brightness of the backlight 102, based on the determination result determined by the brightness determination unit 112.

That is, the brightness control unit 107 computes the maximum image gradation to be set based on the operation amount of the backlight which performs backlight control, the set brightness information of the second screen image G2, and the gradation characteristics of the liquid-crystal panel 101 (step ST5).

Then, the brightness control unit 107 changes the brightness of the second screen image G2 by performing image gradation control to change the second image signal by the specified operation amount based on the computed maximum image gradation to be set (step ST6).

On the other hand, in the determination of step ST3, in the case where the required brightness Y2 is higher than the required brightness Y1 (Y2>Y1), the brightness determination unit 112 outputs the second screen image G2, being the maximum-required-brightness image, and its required brightness Y2, and the first screen image G1, being not the maximum-required-brightness image, and its required brightness Y1, to the brightness control unit 107 as the determination result.

Then, the brightness control unit 107 changes the brightness of the second screen image G2, whose required brightness of the backlight 102 is the highest, by backlight control based on the determination result determined by the brightness determination unit 112. That is, the brightness control unit 107 changes the brightness of the second screen image G2 by the specified operation amount by backlight, and controls the brightness of the backlight 102 to the required brightness Y2 of the second screen image G2 (step ST7).

Next, the brightness control unit 107 also performs image gradation control with respect to the other, second screen image G2, to control the gradation of the image signal in accordance with the change of the brightness of the backlight 102, based on the determination result determined by the brightness determination unit 112.

That is, the brightness control unit 107 computes the maximum image gradation to be set based on the operation amount of the backlight which performs backlight control, the set brightness information of the first screen image G1, and the gradation characteristics of the liquid-crystal panel 101 (step ST8).

Then, the brightness control unit 107 changes the brightness of the first screen image G1 by performing image gradation control to change the first image signal by the specified operation amount based on the computed maximum image gradation to be set (step ST9).

In this manner, principally, the control method (backlight control, image gradation control) is determined by comparing the required brightnesses Y1 and Y2 of the backlight 102 of the screen images G1 and G2 when brightness adjustment starts, and then brightness control may be performed on the corresponding screen, and the order of the control flow can be interchanged appropriately.

Furthermore, in the control flow shown in FIG. 4, the required brightness Y1 and the required brightness Y2 are computed every time. However, by storing the required brightnesses Y1 and Y2 in the storage unit, and by storing them again each time the brightness is changed, it is possible to omit performing the required basic computation of the screen image that does not change every time.

Moreover, in the present control flow, the required brightness is computed before the brightness is changed. However, after the brightness changes the required brightness of the screen image which is changed may be computed and stored in the storage unit. In this case, the stored required brightnesses are compared to determine the control method (backlight control, image gradation control).

Figure 5:
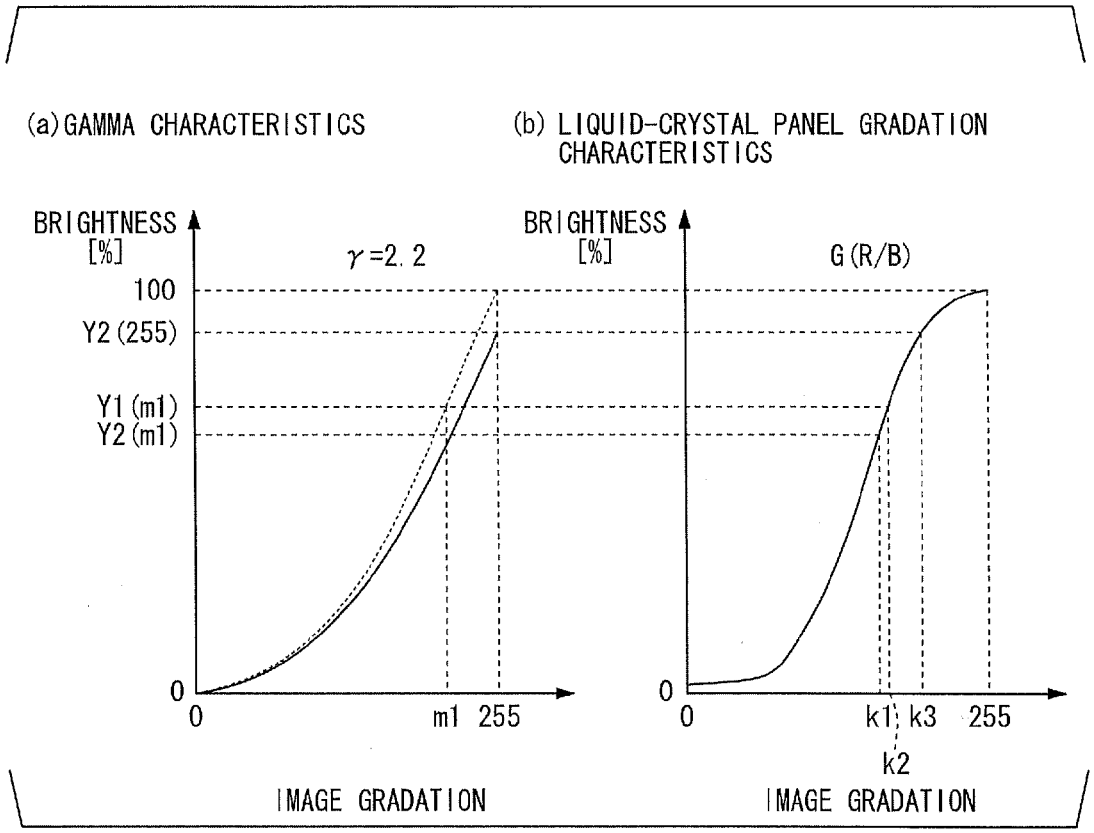
FIG. 5 is a diagram showing the relationship between set gamma characteristics and the gradation characteristics of a liquid-crystal panel.

Next is a description of the relationship between the gamma characteristics setting and the gradation characteristics of a liquid-crystal panel with reference to FIG. 5. FIG. 5 is a diagram showing the relationship between the gamma characteristics setting and the gradation characteristics of a liquid-crystal panel.

As described above, the gradation characteristics of the liquid-crystal panel 101 are stored in the gradation characteristics memory unit 104 for each of R, G, and B. Here is a description of the gradation characteristics of G of the liquid-crystal panel among the gradation characteristics stored in the gradation characteristics memory unit 104. The descriptions of the gradation characteristics of R and B of the liquid-crystal panel are omitted. However, they can be controlled similarly to the description of the gradation characteristics of G of the liquid-crystal panel.

For example, as shown in FIG. 5(*a*), the gradation characteristics of G of the liquid-crystal panel, which are stored in the gradation characteristics memory unit 104 with the Gamma characteristic being γ=2.2, are determined in advance. First is a description of when image gradation control is not performed.

In this case, the gradation of an image signal is converted following the broken line of the gamma curve shown in FIG. 5(*a*). That is, since the brightness=100[%] when the image gradation is 255, the image gradation is converted to 255 in accordance with the characteristics of FIG. 5(*b*).

Furthermore, since the brightness=Y1 (ml) when the image gradation is ml, the gradation characteristic is converted to k2 in accordance with the characteristics of FIG. 5(*b*).

Next is a description of when image gradation control is performed.

For example, as described above, consider control to Gw=0.8864. At this time, since the brightness is set to 88.64 [%], it is converted as shown by the solid line of FIG. 5(*a*). That is, when the image gradation=255, the limit of brightness=88.64[%], and the curve of γ=2.2 is set as the reference.

That is, since the brightness=88.64[%]=Y2 (255) when the image gradation is 255, the image gradation is converted to k3 in accordance with the characteristics of FIG. 5(*b*). Furthermore, since the brightness=Y2 (ml) when the image gradation is ml, the image gradation is converted to k1 in accordance with the characteristics of FIG. 5(*b*).

An image signal converted as described above is supplied to a liquid-crystal panel. As a result, it is possible to maintain the white color temperature even with a medium gradation. Moreover, even if the white point setting is changed, it is possible to set the brightness of white.

Furthermore, since there is a case in which the color temperature of the backlight 102 changes while the backlight 102 starts until the emission of the backlight 102 is stabilized, it is desirable to control by the color temperature of the backlight 102. That is, since the composite ratio of R, G, and B to make the same color temperature as the white point setting when it is stable can be obtained via the color temperature of the backlight 102, the current setting value of the white point may be corrected such that it is the aforementioned composite ratio.

Moreover, as described above, there is a case in which the comparison result of the required brightness of the backlight 102 in each of the screens changes. However, by the above-described processing, it is possible to display an appropriate brightness and medium gradation in each of the screens.

Furthermore, the operating processes in each of the configurations of the above-described display device 100 can be made available in a program for a computer to perform and as a program in a computer readable recording medium, and the above-described processing is performed by the computer system reading and executing it. Here, "computer system" includes a CPU and a range of memory and hardware such as an OS and peripheral equipment.

Moreover, "computer system" also includes a website delivered environment (or display environment) in the case where a WWW system is used.

Furthermore, "computer readable recording medium" denotes a flexible disc, magneto-optical disk, writable non-volatile memory such as a ROM, flash memory or the like, a portable medium such as a CD-ROM, or a storage device such as a hard disc built into a computer system.

Furthermore, a "computer readable recording medium" also includes one that stores a program for a fixed time, like a volatile memory (for example DRAM (Dynamic Random Access Memory)) inside a computer system, which is a server or a client in the case where a program is transmitted via a network such as the Internet or a communication circuit such as a telephone line.

Moreover, the above-described program may be transmitted from a computer system in which the program is stored in a storage device or the like to another computer system via a transmission medium or by transmitted waves in the transmission medium. Here, "transmission medium", which transmits the program, denotes a medium having a function of transmitting information like a network (communication network) such as the Internet, or a communication circuit (communication line) such as a telephone line.

Furthermore, the above-described program may realize part of the aforementioned functions. Moreover, it may be one that can realize the aforementioned functions in combination with a program that is already stored in the computer system, a so-called differential file (differential program).

REFERENCE SYMBOLS

100 Display device
101 Liquid-crystal panel
102 Backlight
103 Control unit
104 Gradation characteristics memory unit
105 Setting unit
106 Settings memory unit
107 Brightness control unit
108 First-screen processing unit
109 Second-screen processing unit
110 Screen composition unit
111 Liquid-crystal panel drive unit
112 Brightness determination unit

The invention claimed is:

1. A display device comprising a liquid-crystal panel and a light source that radiates light from a back of the liquid-crystal panel, and displaying an image on the liquid-crystal panel based on an input image signal, the display device comprising:

a display screen of the liquid-crystal panel, the display screen displaying a plurality of screen images;

a required-brightness computation unit that computes required brightnesses for each of the screen images based on set brightness information indicating a set brightness specified for each of the screen images, the required brightnesses being a brightness of the light source required for making the display screen the set brightness;

a brightness determination unit that compares the required brightnesses computed for each of the screen images, and determines the screen image corresponding to a maximum-required brightness being a highest brightness among the required brightnesses for said each of the screen images to be a maximum-required-brightness image; and a brightness control unit that performs light-source brightness control and performs image gradation control, based on a determination result, the light-source brightness control controlling the brightness of the light source so as to make the brightness of the light source the set brightness for the maximum-required-brightness image, the image gradation control controlling a gradation of the image displayed on the liquid-crystal panel in accordance with the brightness of the light source, so as to make a brightness of said each of the screen images other than the maximum-required-brightness image the set brightness specified for said each of the screen images.

2. The display device according to claim 1, wherein the required-brightness computation unit computes the required brightness for said each of the screen images, based on white point setting information for setting a color temperature when white is displayed on the display screen.

3. The display device according to claim 2, wherein the brightness control unit corrects the white point setting information for setting a color temperature when white is displayed on the display screen in accordance with the brightness of the light source, and displays on the liquid-crystal panel an image whose brightness is adjusted based on the white point setting information after correction.

4. The display device according to claim 1, wherein the brightness control unit adjusts the brightness of said each of the screen images by controlling a brightness of the backlight of said each of the screen images.

5. The display device according to claim 1, wherein the determination result includes information on the screen image with the maximum-required-brightness image, a required brightness for the screen image with the maximum-required-brightness image, the screen images other than the screen image with the maximum-required-brightness image, and required brightnesses for the screen images other than the screen image with the maximum-required-brightness image.

6. The display device according to claim 1, wherein the brightness control unit performs the image gradation control by reducing the brightness of a screen image of the screen images.

7. A display method for a display device comprising a liquid-crystal panel and a light source that radiates light from a back of the liquid-crystal panel, and displaying an image on the liquid-crystal panel based on an input image signal, the display method comprising:

computing required brightnesses for each of screen images based on set brightness information indicating a set brightness specified for said each of the screen images, the required brightness being a brightness of the light source required for making the display screen the set brightness, in a display screen of the liquid-crystal panel displaying the screen images;

comparing the required brightnesses computed for said each of the screen images, and determining the screen image corresponding to a maximum-required brightness being a highest brightness among the required brightnesses for said each of the screen images to be a maximum-required-brightness image; and performing light-source brightness control and image gradation control based on a determination result, the light-source brightness control controlling the brightness of the light source so as to make the brightness of the light source the set brightness for the maximum-required-brightness image, the image gradation control controlling a gradation of the image displayed on the liquid-crystal panel in accordance with the brightness of the light source, so as to make a brightness of said each of the screen images other than the maximum-required-brightness image the set brightness specified for said each of the screen images.

8. The method according to claim 7, wherein said performing light-source brightness control and image gradation control includes adjusting the brightness of said each of the screen images by controlling a brightness of the backlight of said each of the screen images.

9. The method according to claim 7, wherein the determination result includes information on the screen image with the maximum-required-brightness image, a required brightness for the screen image with the maximum-required-brightness image, the screen images other than the screen image with the maximum-required-brightness image, and required brightnesses for the screen images other than the screen image with the maximum-required-brightness image.

10. The method according to claim 7, wherein said image gradation control includes reducing the brightness of a screen image of the screen images.

11. A non-transitory computer readable recording medium storing a program that makes a computer function as:

a required brightness computation unit that computes required brightnesses for each of screen images based on set brightness information indicating a set brightness specified for said each of the screen images, in a display screen of a liquid-crystal panel displaying the screen images, the required brightnesses being a brightness of the light source required for making the display screen the set brightness;

a brightness determination unit that compares the required brightnesses computed for said each of the screen images, and determines the screen image corresponding to a maximum-required brightness being a highest brightness among the required brightnesses for said each of the screen images to be a maximum-required-brightness image; and a brightness control unit that performs light-source brightness control and performs image gradation control, based on a determination result, the light-source brightness control controlling the brightness of the light source so as to make the brightness of the light source the set brightness for the maximum-required-brightness image, the image gradation control controlling a gradation of the image displayed on the liquid-crystal panel in accordance with the brightness of the light source, so as to make a brightness of said each of the screen images other than the maximum-required-brightness image the set brightness specified for said each of the screen images.

12. The non-transitory computer readable recording medium according to claim 1, wherein the brightness control unit adjusts the brightness of said each of the screen images by controlling a brightness of the backlight of said each of the screen images.

13. The non-transitory computer readable recording medium according to claim 11, wherein the determination result includes information on the screen image with the maximum-required-brightness image, a required brightness for the screen image with the maximum-required-brightness image, the screen images other than the screen image with the maximum-required-brightness image, and required brightnesses for the screen images other than the screen image with the maximum-required-brightness image.

14. The non-transitory computer readable recording medium to claim 11, wherein the brightness control unit performs the image gradation control by reducing the brightness of a screen image of the screen images.

* * * * *